US008396243B2

(12) United States Patent
Heng

(10) Patent No.: US 8,396,243 B2
(45) Date of Patent: Mar. 12, 2013

(54) EARPHONE

(75) Inventor: Chin Ngiap Heng, Penang Island (MY)

(73) Assignee: Sony EMCS (Malaysia) Sdn. Bhd., Kuala Lumpur (MY)

( * ) Notice: Subject to any disclaimer, the term of this patent is extended or adjusted under 35 U.S.C. 154(b) by 456 days.

(21) Appl. No.: 12/632,896

(22) Filed: Dec. 8, 2009

(65) Prior Publication Data

US 2010/0142746 A1 Jun. 10, 2010

(30) Foreign Application Priority Data

Dec. 10, 2008 (MY) ..... PI 20084998

(51) Int. Cl.
*H04R 25/00* (2006.01)

(52) U.S. Cl. ..... 381/380; 381/374; 381/379

(58) Field of Classification Search ..... 381/380, 381/374, 379
See application file for complete search history.

(56) References Cited

U.S. PATENT DOCUMENTS

| | | | | |
|---|---|---|---|---|
| 5,544,253 | A | 8/1996 | Nagayoshi et al. | |
| 2006/0203420 | A1 | 9/2006 | Okuyama | |
| 2007/0036385 | A1 * | 2/2007 | Harvey et al. | 381/388 |

FOREIGN PATENT DOCUMENTS

| | | | |
|---|---|---|---|
| JP | 2006-203420 | A | 8/2006 |

* cited by examiner

*Primary Examiner* — Yuwen Pan
*Assistant Examiner* — Matthew Eason
(74) *Attorney, Agent, or Firm* — Wolf, Greenfield & Sacks, P.C.

(57) ABSTRACT

An earphone has a casing that consists of a base housing (12) and a rear housing (10). The base housing and the rear housing enclose the speaker of the earphone and the base housing has an orifice (19) in it so that a wire carrying an audio signal could be provided to the speaker. The base housing is attached to the rear housing using a catch locking mechanism (22, 24). The earphone further includes a ring which fits on the position where the catch lock engages and provides added strength to catch locking mechanism. The earphone is able to withstand a drop from a height of up to 1.8 m with the ring locking mechanism in engaged position on the earphone casing. Furthermore the ring could be easily removed when the earphone requires servicing or repair and reattached for reuse without causing damage to the earphone casing.

14 Claims, 6 Drawing Sheets

EARPHONE

TECHNICAL FIELD

The invention relates to earphones. More specifically it relates to a locking mechanism of an earphone casing.

BACKGROUND ART

Earphones are a type of headphones of smaller size that are placed directly outside of the ear canal without fully enveloping the outer ear. Earphones need to be ergonomically designed in order to universally fit the ears of various users. An earphone encloses a small speaker within it and a wire carries an audio signal to the speaker of the earphone. The casing of the earphone must be designed such that it allows the earphone to be held in the ear canal without the need for any external attachment apparatus. When designing the casing of an earphone there must be a minimum of two parts designed separately that come together to form the earphone. The two parts are a base housing which holds the speaker of the earphone and a rear housing which allows the wire carrying the audio signal to be attached to the earphone and which captures the speaker within the assembled casing.

One problem with the design of an earphone is that if the joining strength of the base housing and the rear housing is not sufficiently strong, the base housing may become detached from the rear housing if the earphone is dropped from a height. An earphone is usually used at eye level of a person which typically would be a height of approximately 1.5-1.8 m. However some earphone casings tend to detach even when dropped from a much lower height of approximately 0.8-0.9 m. Most earphones detach when housings are strained with an impact force of approximately 1.8-2 kg.

As a solution to the above problem some modern earphones use ultrasonic bonding, commonly known as ultrasonic welding to attach the base housing of the earphone to the rear housing. This method permanently seals the earphone casing so that the parts of the housing do not detach when dropped. However the earphone would not be serviceable since the ultrasonic bonding would damage the casing once detached rendering the earphone useless.

Other alternative methods of securing the housing parts, such as the earphone described in U.S. Pat. No. 5,544,253, use a catch locking mechanism where a catch is located on the base housing to lock on to the rear housing of the earphone. The problem with this method is that if the force of the catch locking mechanism is too firm, it will make the two parts difficult to be detached for repairing or servicing purposes. If the force of the catch locking mechanism is too loose the earphone would not be able to withstand the force of a drop from a height. Hence it is difficult to achieve an earphone casing that can withstand a drop test and remain easily removable for repairs by utilizing only a catch locking mechanism.

Object of the Invention

It is an object of the invention to provide an earphone that ameliorates some of the disadvantages and limitations of the known art.

SUMMARY OF THE INVENTION

In a first aspect the invention resides in an earphone having a casing comprising three members, a first member and a second member encasing an earphone speaker in a cavity wherein the first member is removably interlocked with the second member to capture the earphone speaker within the casing, a circular portion of the first member elastically engaging around a circular portion of the second member and the first member is being retained interlocked to the second member by a third member, the third member being a substantially inextensible annular member positionable about the first member at the point where the first member and the second member are interlocked, the annular member preventing the first member from unlocking from the second member and the annular member being capable of being removed from the point where the first member and the second member are interlocked, wherein the first member may be detached from the second member without causing damage to the first member or the second member when the annular member is removed.

Preferably the annular member is made of polyoxymethylene.

Preferably the annular member is circular in shape.

Preferably the annular member has a notch on an inner edge which engages with a protuberance on the first or second member and so retains the annular member to the point where the first member and the second member are joined.

Preferably the first member has an opening that allows a speaker wire to be extended outwards from the cavity.

Preferably interlocking the first member with the second member through the use of an annular member allows the first member and the second member to remain interlocked when a separating force of up to 5 kg is applied.

Preferably interlocking the first member with the second member through the use of an annular member allows the first member and the second member to remain interlocked when the earphone is dropped from a height of up to 1.8 m, 18 times over.

In a second embodiment the invention relates to a method of interlocking a first member to a second member to form an enclosed cavity capable of receiving an earphone speaker, comprising the steps of:

elastically interlocking a circular portion of a catch member of the first member with a circular portion of a catch member of the second member, attaching a substantially inexpansible annular member to the first member and the second member such that the annular member encircles the interlocked catch member of the first member and the catch member of the second member, such that the annular member prevents the catch member of the first member and the catch member of the second member being unlocked.

Preferably the annular member can be removed allowing the catch member of the first member and the catch member of the second member to be separated.

Preferably the annular member is made of polyoxymethylene.

Preferably the annular member is circular in shape.

Preferably the annular member has a notch on an inner edge which secures the annular member to the point where the first member and the second member are joined.

Preferably the enclosed cavity formed when the first member and the second member are joined, is capable of housing an earphone speaker.

Preferably the first member has an opening that allows a speaker wire to be extended outwards from the cavity.

BRIEF DESCRIPTION OF THE DRAWINGS

An embodiment of the invention will now be described, by way of example only, by reference to the accompanying drawings.

DETAILED DESCRIPTION OF THE DRAWINGS

The following description will describe the invention in relation to preferred embodiments of the invention, namely an earphone. The invention is in no way limited to these preferred embodiments as they are purely to exemplify the invention only and many possible variations and modifications would be readily apparent without departing from the scope of the invention.

Figure 1:
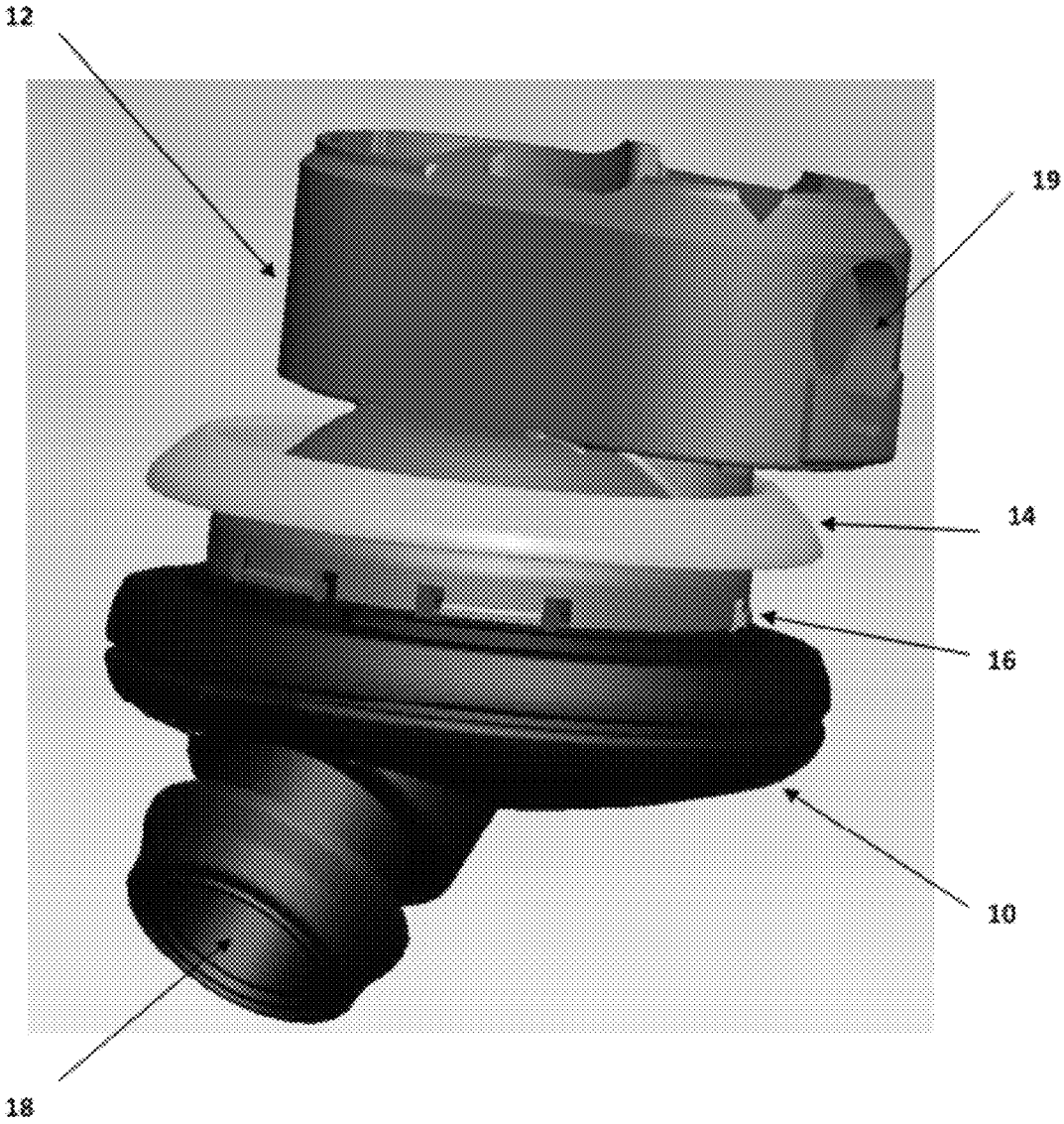
FIG. 1 is a perspective view of the earphone in accordance with a first preferred embodiment of the invention before the annular locking mechanism is engaged.
Figure 2:
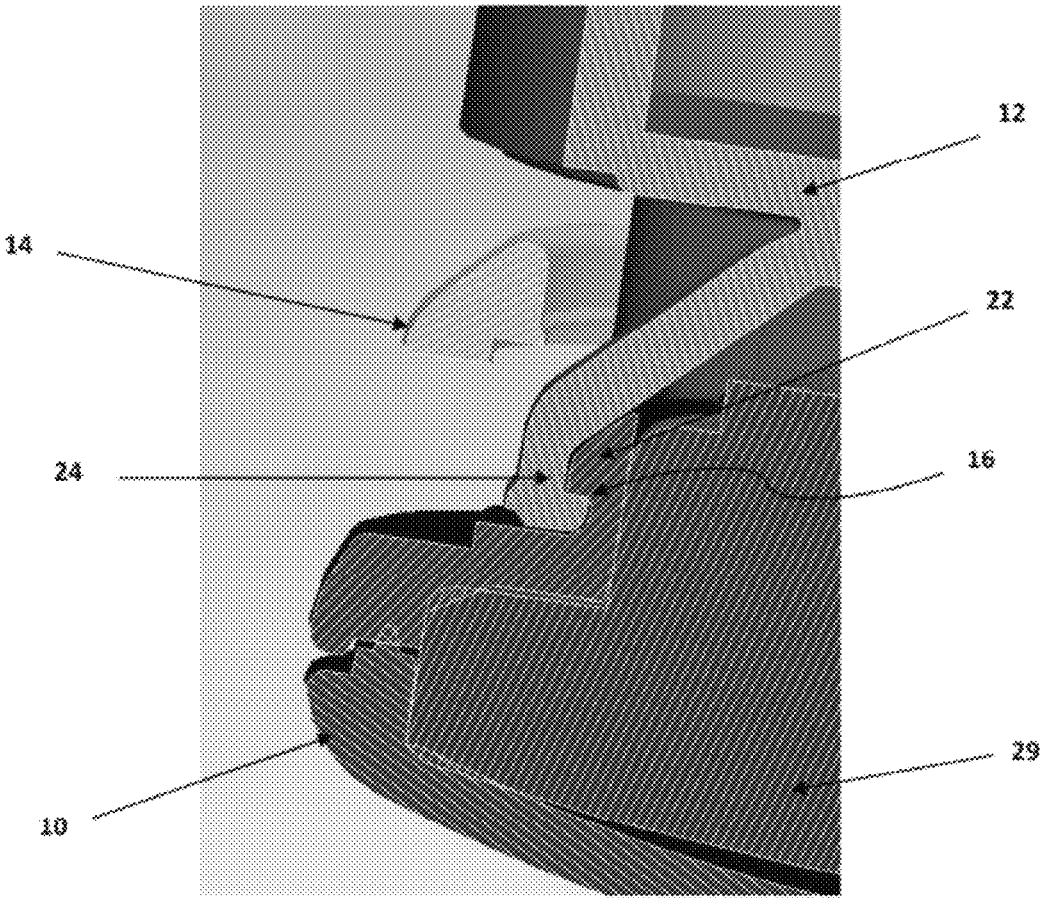
FIG. 2 is a cross-sectional side view of the earphone in accordance with a first preferred embodiment of the invention before the annular locking mechanism is engaged.

FIGS. 1 and 2 both show an earphone in accordance with the first preferred embodiment of the invention. It mainly comprises of two pieces; a rear housing 10 and a base housing 12 joined together using a locking mechanism unique to the earphones of this invention. The locking mechanism utilizes a locking annulus 14 which fits on to the point 16 where the rear housing and the base housing is joined as shown and which is substantially inextensible so that it can only be forced away from the joint with difficulty. At the point 16, the rear housing is fitted on to the base housing with a catch locking mechanism which is described later in more detail. The rear housing 10 has an orifice 18 which allows the sound from a speaker held within the earphone to be directed towards the inner ear of a user of the earphone.

Figure 3:
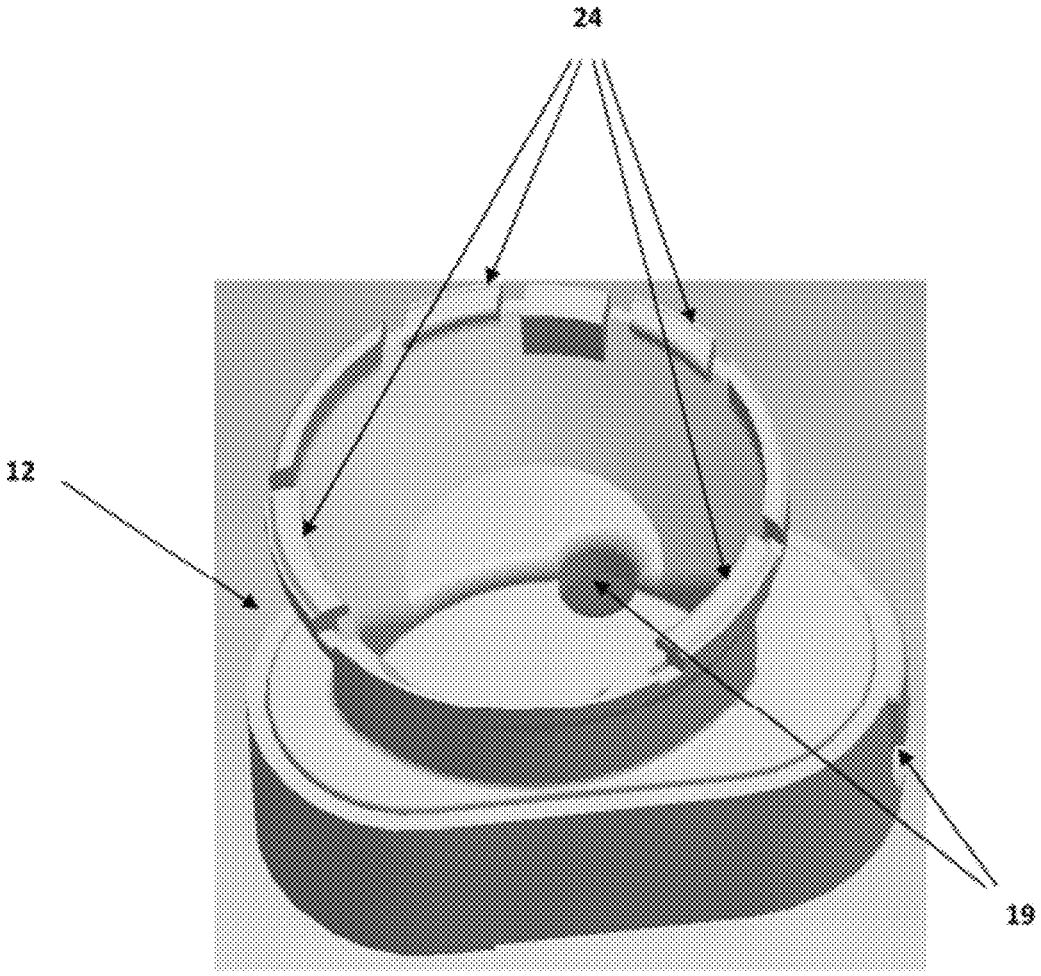
FIG. 3 is a perspective view of the base housing.

FIG. 3 shows the base housing 12, illustrating with clarity the catch lock 24 and the orifice 19 which allows a wire to be run from the speaker held within the earphone. The wire carries an audio signal into the speaker. The speaker would be held within the cavity formed by joining the rear housing and the base housing.

Figure 4:
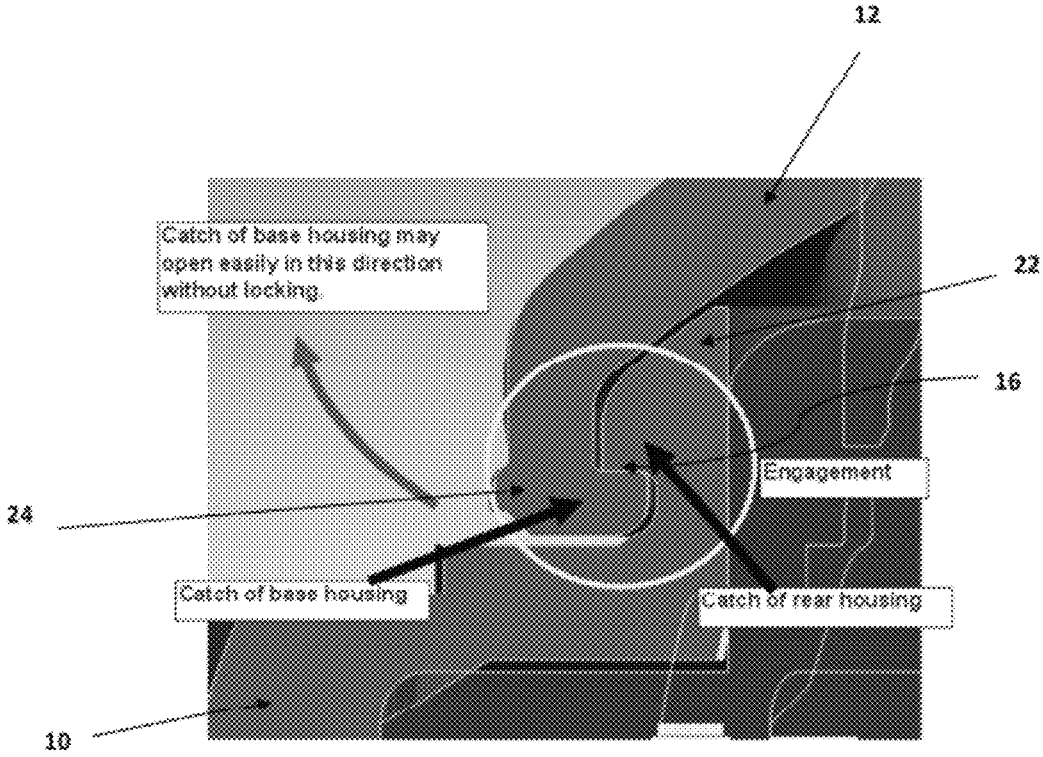
FIG. 4 is a close-up cross-sectional side view of the earphone in accordance with a first preferred embodiment of the invention showing the catch locking system of the rear housing and base housing engaged.

FIG. 4 shows an earphone in accordance with the first preferred embodiment of the invention where the catch locking system of the rear housing 10 and the base housing 12 is interlocked. The rear housing 10 has a catch 22 which locks on to another catch 24 of the base housing 12 when the catch lock is locked in place. The point 16 where the catch engages is approximately 0.2 mm in length and the two catches 22, 24 grip firmly together along this point. The locking annulus 14 shown in FIG. 2 is omitted due to a comprehensible explanation about the catch locking system of the rear housing 10 and the base housing 12.

Figure 5:
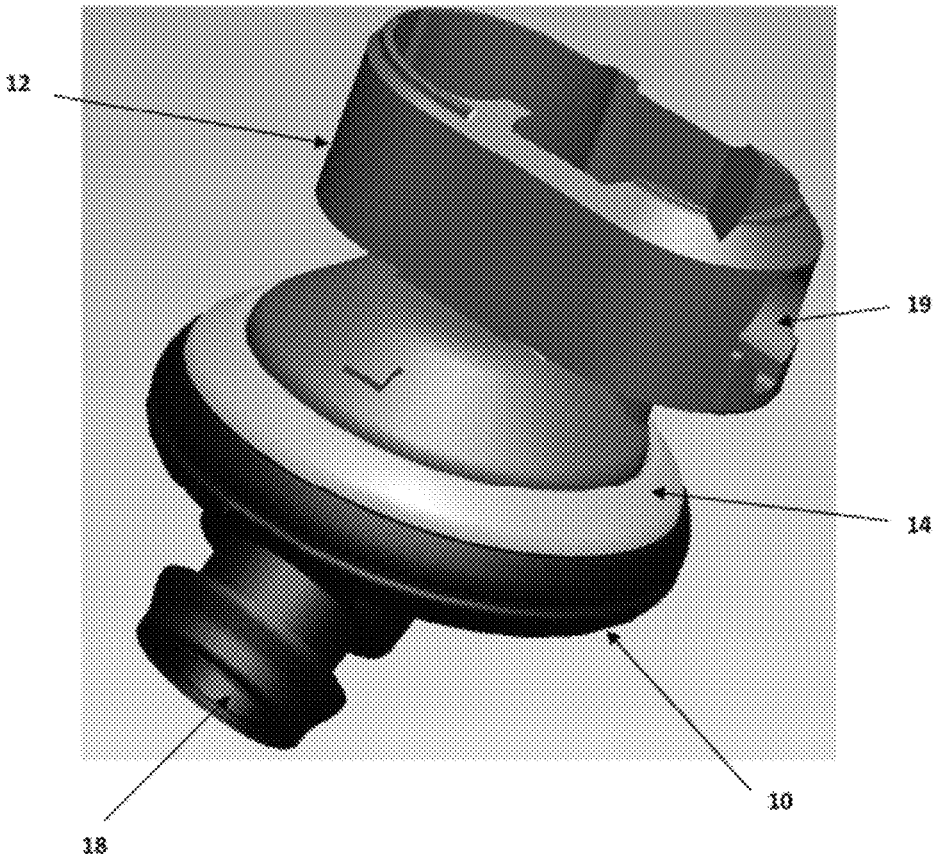
FIG. 5 is perspective view of the earphone with the annular locking mechanism engaged in accordance with a first preferred embodiment of the invention.
Figure 6:
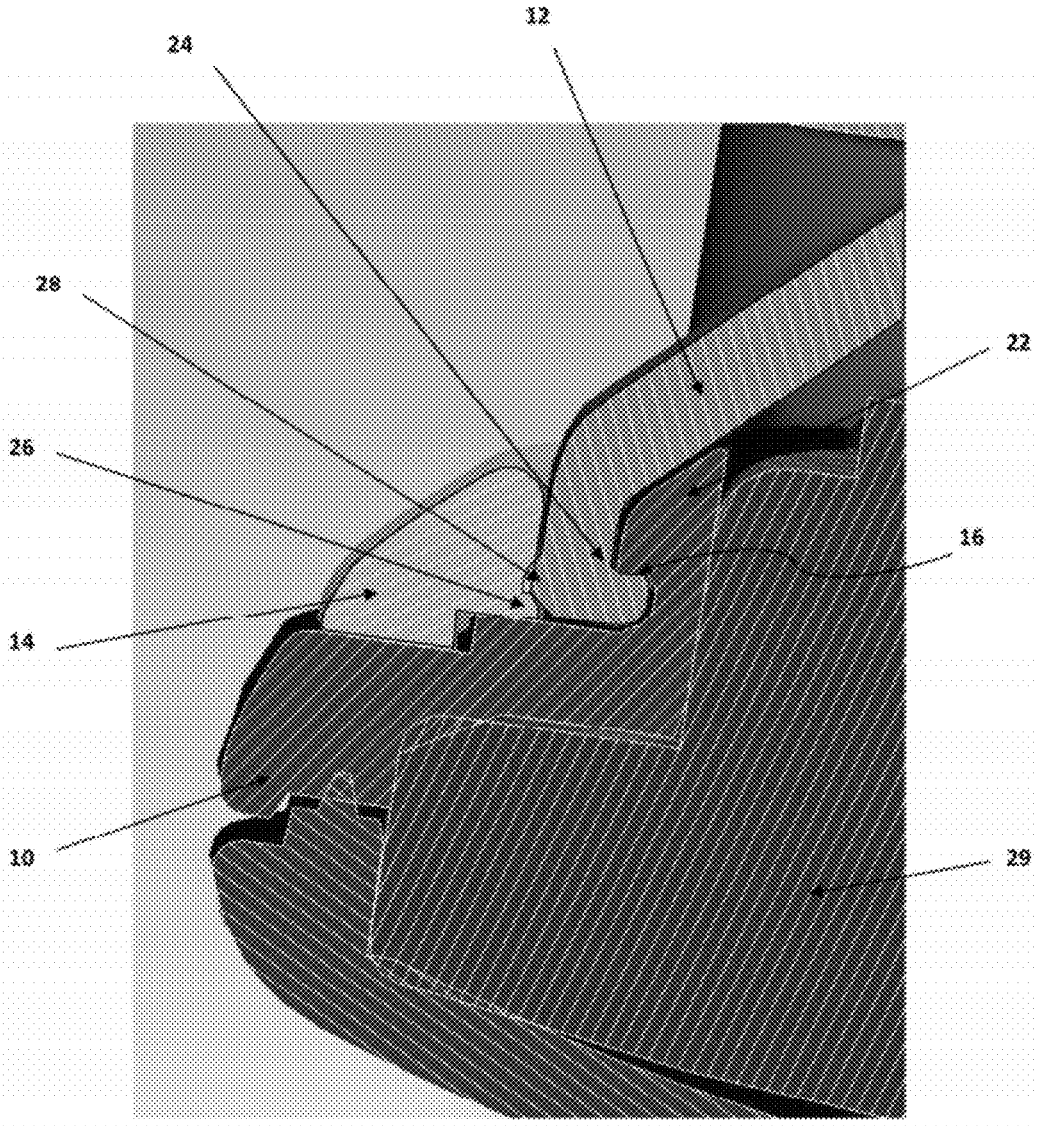
FIG. 6 is a cross-sectional side view of the earphone with the annular locking mechanism engaged in accordance with a first preferred embodiment of the invention.

FIGS. 5 and 6 both show the earphone in accordance with the first preferred embodiment of the invention where the locking annulus 14 is pushed onto the position where the catch lock of the earphone is located in order to prevent the catch lock from disengaging in case the earphone is dropped. The annulus 14 is moulded to fit above the surface of the casing of the earphone firmly. In order to ensure that it does loosen and fall off from its position, the annulus 14 has a notch 26 which fits firmly below protuberance 28 situated on the base housing 12. The point where the two notches engage may preferably be 0.15 mm and 0.25 mm in length as shown in FIG. 6. The shaded area 29 of FIG. 6 shows the cavity where the speaker of the earphone is held. The housing is dimensioned such that the speaker would be firmly held once the catch lock of the base housing and the rear housing is engaged and the annulus 14 is locked into place.

The annulus 14 may easily be removed for servicing or repairing of the earphone. A flat plate tool may be slid under the annulus and pushed upward so that the notch 26 of the annulus would be released from the grip of the protuberance 28 of the base housing. Once the annulus is removed the catch lock 22, 24 of the earphone may easily be released by twisting the base housing off the rear housing in an upward direction. Once servicing or repair is done the earphone may be reconstructed by placing the rear housing and the base housing together and locking the catch lock 22, 24 and locking the notch 26 of the annulus 14 into place. The annulus 14 may preferably be constructed from polyoxymethylene (POM) which is a strong yet lightweight plastic polymer material well suited for the manufacture of the annulus. Alternatively other materials may also be used to manufacture the annulus 14. However materials such as Acrylonitrile butadiene styrene (ABS) or polycarbonate+Acrylonitrile butadiene styrene (PC+ABS) are not suitable for the annulus 14 since the material is brittle and easily broken. The thickness of the edge of the annulus may preferably be between 0.7 mm and 1 mm. The thickness of the annulus is limited due to the fact that the earphone is intended to be used at the ear canal of a user and an increase size of the earphone may cause it to not fit in the ear canal. Therefore the annulus should be within the above mentioned limits so that the size of the earphone would not be affected by the addition of an annulus to the earphone.

The importance of the presence of the annulus could be clearly seen in FIG. 6. The annulus 14 tends to act as a barrier to stop the catch lock 22, 24 of the earphone casing from disengaging unintentionally or during a fall from a high place. It tends to strengthen the catch lock 22, 24 by preventing the catch 24 of the base housing 12 from moving outwards which releases the catch locking mechanism. Furthermore the annulus could be easily removed when required as described above and the catch lock could be easily disengaged once the annulus is removed without causing any damage to the casing of the earphone. Therefore the annulus 14 is a vital component of the earphone described in this invention and it acts as a key to locking and unlocking the catch lock of the earphone.

Advantages

One advantage of the present invention is that it uses a removable annulus that fits around the catch lock of the base housing and the rear housing of the earphone which increases the strength of the catch lock. Tests have been carried out on the earphone described above which have shown that the catch lock of the earphone would remain engaged even when dropped from a height of 1.8 m continuously up to 18 times. The force required to detach the base housing from the rear housing is more than 5 kg with the annular lock engaged. This proves that the ring locking mechanism provides higher strength to the earphone casing than when the earphone is attached by using only a catch lock where the force required to remove the annular lock was only 1.8-2 kg.

The rear housing and the base housing of the earphone could be easily removed when the earphone requires repair or servicing. The annulus could be removed as described in the above description and the catch lock could be released by applying a force of only 1.6-1.9 kg. Removing the annular lock and separating the casing would not cause any damage to the earphone.

Variations

Even though the annular locking mechanism is only applied to an earphone as described in the first preferred embodiment of the invention it may be applied to various other types of devices such as headsets or headphones or the like. The locking mechanism of the present invention would be useful in a situation where it is required to lock two housings of a casing into position with sufficient strength that the lock would not disengage the housings when dropped from a height and also the lock could be easily disengaged when the device requires servicing or repair. The dimensions of the annulus could be varied as required, depending on the size constraints of the device to which the locking mechanism has been applied.

Throughout the description of this specification, the word "comprise" and variations of that word such as "comprising" and "comprises", are not intended to exclude other additives, components, integers or steps.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

The invention claimed is:

1. An earphone comprising:

a casing comprising three members, wherein a first member and a second member encase an earphone speaker in a cavity wherein the first member is removably interlocked with the second member to capture the earphone speaker within the casing, wherein a circular portion of the first member elastically engages around a circular portion of the second member and the first member is retained interlocked to the second member by a third member, wherein the third member is a substantially inextensible annular member positionable about the first member at the point where the first member and the second member are interlocked, the annular member preventing the first member from unlocking from the second member and the annular member being capable of being removed from the point where the first member and the second member are interlocked, wherein the first member may be detached from the second member without causing damage to the first member or the second member when the annular member is removed.

2. An earphone as claimed in claim 1, wherein the annular member is made of polyoxymethylene.

3. An earphone as claimed in claim 1, wherein the annular member is circular in shape.

4. An earphone as claimed in claim 1, wherein the annular member has a notch on an inner edge which engages with a protuberance on the first or second member and so retains the annular member to the point where the first member and the second member are joined.

5. An earphone as claimed in claim 1, wherein the first member has an opening that allows a speaker wire to be extended outwards from the cavity.

6. An earphone as claimed in claim 1, wherein interlocking the first member with the second member through the use of the annular member allows the first member and the second member to remain interlocked when a separating force of up to 5 kg is applied.

7. An earphone as claimed in claim 1, wherein interlocking the first member with the second member through the use of the annular member allows the first member and the second member to remain interlocked when the earphone is dropped from a height of up to 1.8 m, 18 times over.

8. A method of interlocking a first member to a second member to form an enclosed cavity capable of receiving an earphone speaker, the method comprising:

elastically interlocking a circular portion of a catch member of the first member with a circular portion of a catch member of the second member, and attaching a substantially inexpansible annular member to the first member and the second member such that the annular member encircles the interlocked catch member of the first member and the catch member of the second member, wherein, following the attaching, the annular member prevents the catch member of the first member and the catch member of the second member from being unlocked.

9. A method as claimed in claim 8, wherein the annular member can be removed allowing the catch member of the first member and the catch member of the second member to be separated.

10. A method as claimed in claim 8, wherein the annular member is made of polyoxymethylene.

11. A method as claimed in claim 8, wherein the annular member is circular in shape.

12. A method as claimed in claim 8, wherein the annular member has a notch on an inner edge which secures the annular member to the point where the first member and the second member are joined.

13. A method as claimed in claim 8, wherein the enclosed cavity formed when the first member and the second member are joined is capable of housing an earphone speaker.

14. A method as claimed in claim 8, wherein the first member has an opening that allows a speaker wire to be extended outwards from the enclosed cavity.

* * * * *